United States Patent [19]

Leifeld et al.

[11] Patent Number: 5,072,490

[45] Date of Patent: Dec. 17, 1991

[54] FIBER BALE OPENER WITH BLOW NOZZLE

[75] Inventors: Ferdinand Leifeld, Kempen; Josef Temburg, Jüchen, both of Fed. Rep. of Germany

[73] Assignee: Trützschler GmbH & Co. KG, Mönchengladbach, Fed. Rep. of Germany

[21] Appl. No.: 597,692

[22] Filed: Oct. 12, 1990

[30] Foreign Application Priority Data

Oct. 12, 1989 [DE] Fed. Rep. of Germany ..... 3934039

[51] Int. Cl.[5] ..... D01G 7/00

[52] U.S. Cl. ..... 19/80 R; 53/381.2; 414/412

[58] Field of Search ..... 414/412, 291, 292; 19/80 R; 53/381.2, 381 R; 406/70, 103, 93, 151, 152

[56] References Cited

U.S. PATENT DOCUMENTS

| | | | |
|---|---|---|---|
| 1,918,330 | 7/1933 | Green | 406/152 X |
| 3,949,448 | 4/1976 | Willcutt et al. | 19/80 R |
| 4,554,708 | 11/1985 | Leifeld et al. | 19/80 R |
| 4,660,257 | 4/1987 | Binder et al. | 19/80 R |
| 4,671,708 | 6/1987 | Hurd | 406/152 X |
| 4,750,240 | 6/1988 | Temburg | 19/80 R |
| 4,785,504 | 11/1988 | Leifeld et al. | 19/80 R |
| 4,912,811 | 4/1990 | Walk | 19/80 R |
| 4,944,071 | 7/1990 | Marzoli et al. | 19/80 R |

FOREIGN PATENT DOCUMENTS

| | | | |
|---|---|---|---|
| 3637351 | 8/1987 | Fed. Rep. of Germany | 19/80 R |

*Primary Examiner*—Robert L. Spruill
*Assistant Examiner*—Daniel B. Moon
*Attorney, Agent, or Firm*—Spencer & Frank

[57] ABSTRACT

A bale opener includes a housing moved along a travelling path, and an opening roll which is mounted in the housing for removing fiber tufts from faces of fiber bales arranged in a series along the travelling path and which has a longitudinal axis lying in a plane oriented perpendicularly to the travelling path. There is further provided a suction device that generates a suction stream within the housing for removing, from a zone of the opening roll, fiber tufts detached by the opening roll from the fiber bales. A pressurized air stream generating device blows air in an upwardly inclined direction into the housing for essentially preventing fiber material from dropping off the fiber bales over upper edges thereof.

11 Claims, 3 Drawing Sheets

FIBER BALE OPENER WITH BLOW NOZZLE

CROSS REFERENCE TO RELATED APPLICATION

This application claims the priority of Federal Republic of Germany Application No. P 39 34 039.2 filed Oct. 12th, 1989, which is incorporated herein by reference.

BACKGROUND OF THE INVENTION

This invention relates to a fiber bale opener for removing fiber tufts from the top face of fiber bales. The fiber bale opener comprises at least one detaching (opening) roll which is mounted in a back-and-forth travelling housing. The detached fiber tufts are removed by a suction device from the zone of the opening roll.

In conventional fiber bale openers, fiber material which is not drawn away by the suction device, may drop to the floor laterally of the bales. Risks are considerable that such fiber material is, during operation, drawn in by the opening device and may cause clogging thereof. On the other hand, any fiber material which remains on the floor has to be eventually manually removed which is a labor-intensive operation.

SUMMARY OF THE INVENTION

It is an object of the invention to provide an improved bale opener of the above-outlined type from which the discussed disadvantages are eliminated and which thus, in particular, prevents the fiber material from dropping off the fiber bales and ensures an improved removal of the fiber material by suction.

This object and others to become apparent as the specification progresses, are accomplished by the invention, according to which, briefly stated, a blow nozzle is positioned in the zone of the upper edges of the fiber bales such that the nozzle opening is oriented obliquely upwardly towards the fiber bale edges.

The air blast emanating from the blow nozzles arranged according to the invention prevents fiber material from dropping to the floor. Instead, the fiber tufts are blown upwardly into the vacuum stream generated by the suction device whereby the air stream generated by the blow nozzles provides for an oriented support of the suction stream which results in a significantly improved suction removal of the fiber material.

According to a further feature of the invention, the blow nozzles are connected with pipes with an air pressure source. Advantageously, the blow nozzles are mounted on the travelling opener housing. Advantageously, the blow nozzles are directed towards the upper frontal and rear edges of the fiber bales. According to another feature of the invention, the blow nozzles are stationarily mounted adjacent the vertical front and rear faces of the fiber bale series. According to another feature of the invention, the blow nozzles are arranged along that side of an opener grate which is oriented away from the opening roll.

The invention further includes a bale opener for detaching fiber tufts from, for example, cotton bales or chemical fiber bales, wherein the opening device works on the fiber bale surfaces at an inclination to the bale supporting surface and wherein transversely to the travelling direction two opening rolls, whose axes are arranged at an angle to one another, lie substantially in a single vertical plane which is oriented transversely to the travelling direction of the bale opener. The angle between the two opening rolls is adjustable and may assume a zero value in which case the two rolls are in an axially aligned arrangement.

According to a further embodiment of the invention, the opening device comprises two opening rolls which are spaced parallel to the working direction (that is, in the travelling direction) of the bale opener; each roll may be adjusted in a vertical plane in its inclination relative to the fiber bales. The two rolls may be so adjusted that their axes assume a parallel orientation relative to one another.

DESCRIPTION OF THE PREFERRED EMBODIMENTS

Figure 1A:
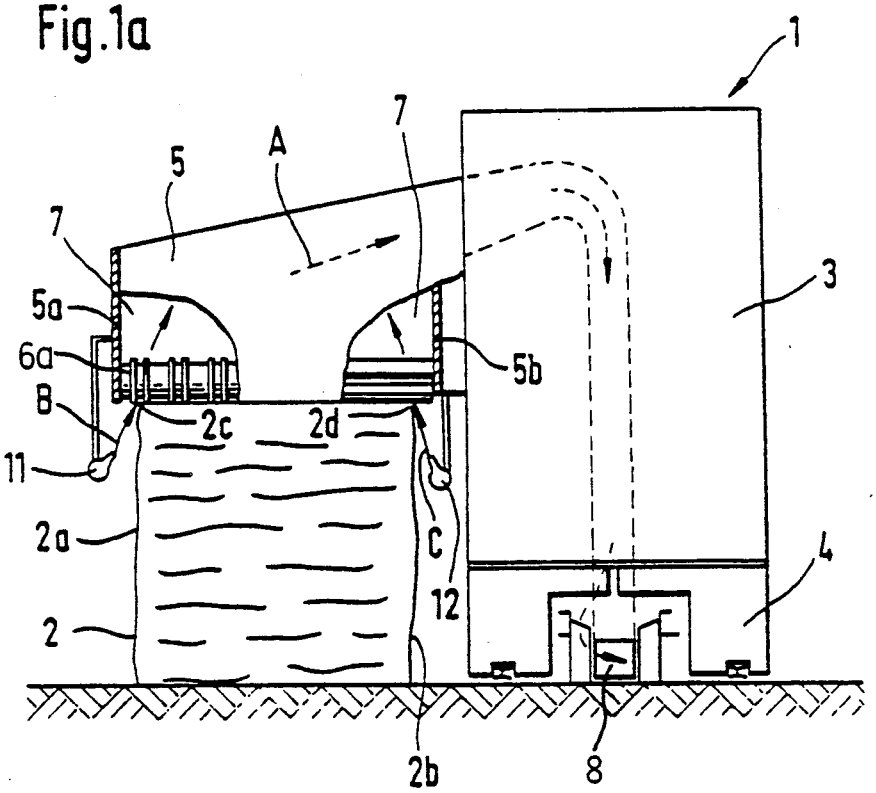
FIG. 1*a* is a schematic front elevational view of a bale opener incorporating the invention.
Figure 1B:
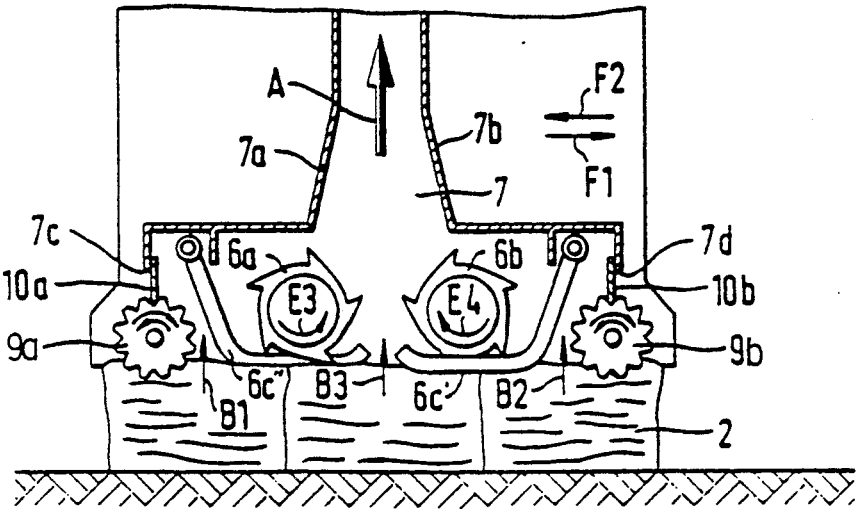
FIG. 1*b* is a schematic sectional side elevational view of the construction shown in FIG. 1*a*.

FIGS. 1*a* and 1*b* illustrate a bale opener 1 which may be, for example, a BLENDOMAT model, manufactured by Trützschler. GmbH & Co. KG, Mönchengladbach, Federal Republic of Germany. The bale opener 1 includes a tower 3 which is mounted on a carriage 4 displaceable back and forth along a series of fiber bales 2 as indicated by arrows F1 and F2. The tower 3 supports a cantilever housing 5 which may be raised and lowered with respect to the tower 3. In the housing 5 there is accommodated the opening device (fiber tuft detaching device) proper which includes, for example, two opening rolls 6*a*, 6*b* and a suction device 7 which generates a suction stream A for carrying away the fiber tufts detached by the opening rolls 6*a*, 6*b* as the bale opener 1 travels along the series of fiber bales 2. Underneath the tower 3 there is disposed a trough 8 which receives the fiber tufts from the suction device 7 and from which the fiber material is further transported by the suction stream.

The two axially parallel arranged opening rolls 6*a*, 6*b* are flanked by spiked pressing rolls 9*a* and 9*b* which are supported in the housing 5 and which extend parallel to the opening rolls 6*a*, 6*b*.

The housing 5 supports two grates 6*c*' and 6*c*'' which extend underneath the respective opening rolls 6*b* and 6*a* transversely thereto.

The suction device 7 has opposite walls 7*a* and 7*b* which terminate in lower edges 7*c* and 7*d* that extend above and along the respective pressing rolls 9*a* and 9*b*. The gap between the respective pressing rolls 8 and 9 and the respective lower wall edges 7*c* and 7*d* is closed by respective sealing elements 10*a*, 10*b* which prevent external air from entering the suction device 7.

The opening rolls 6*a* and 6*b* are rotated in the direction of the respective arrows E3 and E4 such that the fiber material detached by the rolls from the fiber bales 2 is thrown inwardly, that is, towards one another in the working zone thereof and upwardly into the air stream A generated in the suction device 7.

The pressing rolls 9*a* and 9*b* are composed of star-shaped discs which penetrate into the surface of the fiber bale and serve for pressing down and thus stabilizing the fiber bales. The sealing elements 10*a* and 10*b* are of an elastic material and extend between the teeth or spikes of the star-shaped discs that compose the pressing rolls 9*a* and 9*b*. In this manner, air from the outside is prevented from entering into the suction device 7 from above the bales 2 between the pressing rolls 9*a* and 9*b* and the walls 7*a* and 7*b* of the suction device 7. Such externally admitted air would constitute an undesirable air stream which would weaken the suction effect of the suction stream A. The zone between the lower ends 7*c*, 7*d* of the side walls 7*a*, 7*b* and the top of the pressing rolls 9*a* and 9*b* above the bales 2 is thus sealed at those sides of the opening rolls 6*a*, 6*b* which are oriented away from one another.

In the zone of the upper edges 2*c*, 2*d* of the fiber bales 2 respective blow nozzles 11 and 12 are arranged whose outlet opening is oriented obliquely upwardly towards the bale edges 2*c*, 2*d*. The blow nozzles 11 and 12 are fixedly suspended from the housing 5 and thus move therewith in unison. From the nozzles 11 and 12 respective air streams B and C are emitted which enter from the outside into the suction device 7 solely externally of the vertical projection of the two vertical bale faces 2*a* and 2*b*. Between the lateral walls 5*a* and 5*b* of the housing 5 and the corresponding bale walls 2*a* and 2*b* the air streams B and C may enter essentially from below into the suction device 7. FIG. 1*b* shows the air streams B1, B2 and B3 emanating from respective blow nozzles which, however, are not illustrated in FIG. 1*b*.

Figure 2:
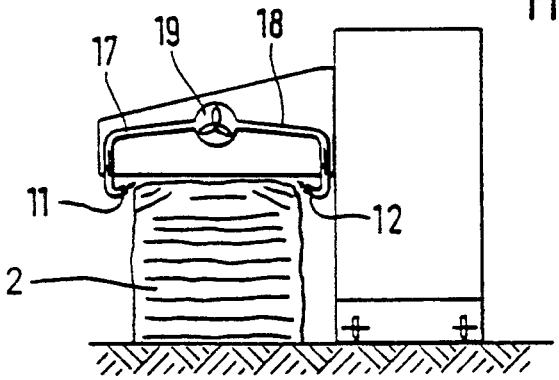
FIG. 2 is a schematic end elevational view of a bale opener incorporating a preferred embodiment of the invention.
Figure 3:
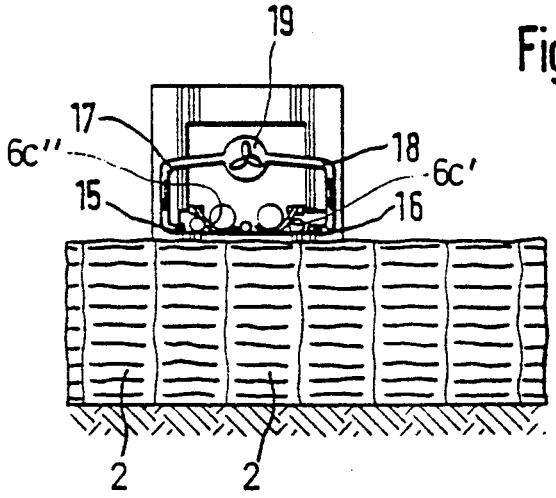
FIG. 3 is a schematic side elevational view of a bale opener incorporating still another preferred embodiment of the invention.
Figure 4:
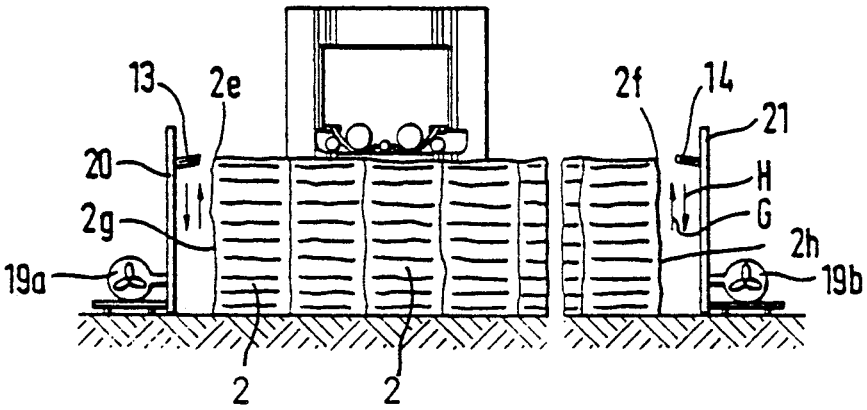
FIG. 4 is a schematic side elevational view of a bale opener incorporating yet another preferred embodiment of the invention.

Turning to FIG. 2, the blow nozzles 11 and 12 are connected with an air pressure generator (fan) 19 by means of conduits 17 and 18 and are situated laterally of the fiber bales 2. According to FIG. 3, blow nozzles 15, 16 are arranged along the width of that side of the grates 6*c*′ and 6*c*″ which are oriented away from the opening rolls 6*a* and 6*b*. According to the embodiment shown in FIG. 4, the blow nozzles 13 and 14 are entirely detached from the bale opener and are arranged on posts 20 and 21 at opposite longitudinal ends of the fiber bale series and are oriented towards the transverse edges 2*e* and 2*f* of the vertical end walls 2*g* and 2*h* of the series composed of the fiber bales 2. The nozzles 13 and 14 which are supplied with pressurized air by respective blowers 19*a*, 19*b*, may change their vertical position as indicated by the arrows G and H.

Figure 5A:
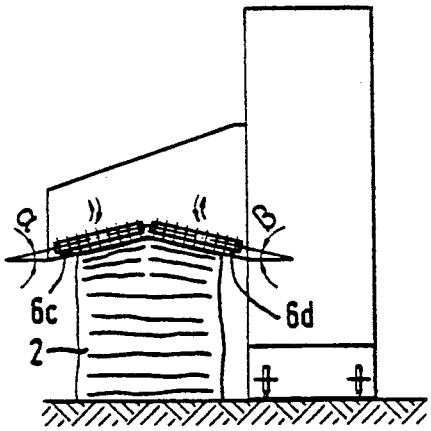
FIGS. 5*a* and 5*b* are schematic end elevational views of still another preferred embodiment of the invention, showing different operational positions.
Figure 5B:
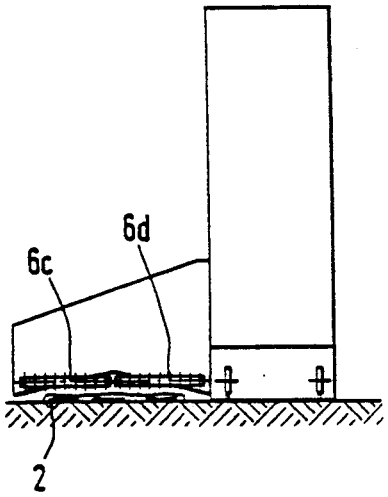

Turning to FIGS. 5*a* and 5*b*, the opening device of the bale opener comprises two opening rolls 6*c* and 6*d* which are arranged axially side-by-side, that is, their respective longitudinal axes lie essentially in a common vertical plane oriented perpendicularly to the direction of travel of the bale opener. The angle of the opening rolls 6*c* and 6*d* may be adjusted in a vertical plane. As shown in FIG. 5*a*, the two opening rolls 6*c* and 6*d* are at a respective inclination $\alpha$ and $\beta$ with regard to the horizontal, whereas in FIG. 5*b* the inclination of the two opening rolls 6*c* and 6*d* has been changed to assume a coaxial (axially aligned) orientation when the height of the fiber bales has been reduced to a value close to zero.

Figure 6A:
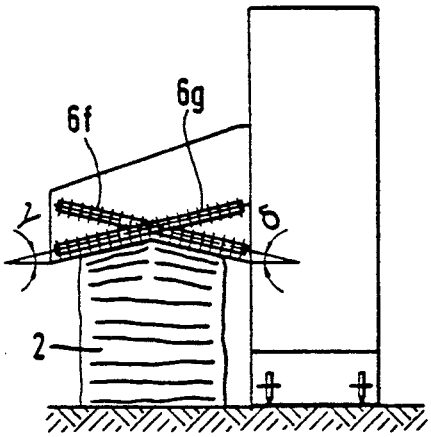
FIGS. 6*a* and 6*b* are schematic end elevational views of a further preferred embodiment of the invention, showing different operational positions.
Figure 6B:
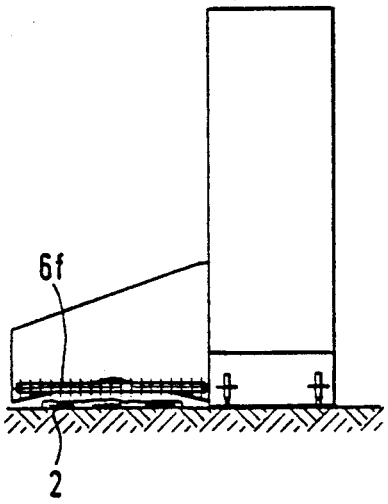

In the embodiment illustrated in FIGS. 6*a* and 6*b* the opening device of the bale opener comprises two opening rolls 6*f* and 6*g* which are spaced in a direction parallel to the travelling direction of the bale opener. The two opening rolls 6*f* and 6*g* may be arranged at a respective inclination $\delta$ and $\gamma$ relative to the horizontal, as shown in FIG. 6*a*. As shown in FIG. 6*b*, as the height of the fiber bales has been reduced almost to zero, the inclination of the rolls 6*f* and 6*g* (the latter is not visible in FIG. 6*b*) has been reduced to zero and thus the two opening rolls assume an axially parallel orientation.

It will be understood that the above description of the present invention is susceptible to various modifications, changes and adaptations, and the same are intended to be comprehended within the meaning and range of equivalents of the appended claims.

What is claimed is:

1. In a bale opener including a housing, means for effecting travel of the housing along a travelling path, an opening roll mounted in the housing for removing fiber tufts from faces of fiber bales arranged in a series along the travelling path; the opening roll having a longitudinal axis lying in a plane oriented perpendicularly to the travelling path; and a suction means generating a suction stream within the housing for removing, from a zone of the opening roll, fiber tufts detached by the opening roll from the fiber bales; the improvement comprising pressurized air stream generating means for blowing air from a location outside the housing in an upwardly inclined direction into said housing for essentially preventing fiber material from dropping off the fiber bales over upper edges thereof.

2. A bale opener as defined in claim 1, wherein said pressurized air stream generating means comprises a blow nozzle and support means for positioning the blow nozzle externally of said housing.

3. A bale opener as defined in claim 2, wherein said pressurized air stream generating means comprises a fan and a conduit coupling said fan with said blow nozzle.

4. A bale opener as defined in claim 2, wherein said support means comprises a mounting attaching said blow nozzle to said housing, whereby said blow nozzle and said housing move as a unit.

5. A bale opener as defined in claim 4, wherein said bale opener further comprises a grate mounted in said housing and extending transversely to said opening roll; said grate having a side oriented away from said opening roll; said blow nozzle being arranged adjacent said side of said grate.

6. A bale opener as defined in claim 4, wherein said mounting orients the pressurized air stream towards an upper horizontal bale edge extending parallel to the travelling path.

7. A bale opener as defined in claim 2, wherein said support means comprises a support positioning said blow nozzle at an end of said travelling path and orienting the pressurized air stream towards an upper horizontal bale edge extending transversely to the travelling path.

8. A bale opener as defined in claim 1, wherein said opening roll is a first opening roll; further comprising a second opening roll mounted in said housing; said first and second opening rolls are situated in a series in a direction transverse to the travelling path; said first and second opening rolls being adjustable in a vertical plane to assume a desired inclined orientation to the horizontal.

9. A bale opener as defined in claim 8, wherein said opening rolls are adjustable into a position in which longitudinal axes of the opening rolls extend in alignment with one another.

10. A bale opener as defined in claim 1, wherein said opening roll is a first opening roll; further comprising a second opening roll mounted in said housing; said first and second opening rolls are spaced parallel to the travelling path; said first and second opening rolls being adjustable in a vertical plane to assume a desired inclined orientation to the horizontal.

11. A bale opener as defined in claim 10, wherein said opening rolls are adjustable into a position in which longitudinal axes of the opening rolls extend parallel to one another.

* * * * *